US006414317B1

(12) United States Patent
Francke et al.

(10) Patent No.: US 6,414,317 B1
(45) Date of Patent: Jul. 2, 2002

(54) RADIATION DETECTOR, AN APPARATUS FOR USE IN PLANAR BEAM RADIOGRAPHY AND A METHOD FOR DETECTING IONIZING RADIATION

(75) Inventors: Tom Francke, Sollentuna; Vladimir Peskov, Stockholm, both of (SE)

(73) Assignee: Xcounter AG, Danderyd (SE)

( * ) Notice: Subject to any disclaimer, the term of this patent is extended or adjusted under 35 U.S.C. 154(b) by 0 days.

(21) Appl. No.: 09/444,569

(22) Filed: Nov. 19, 1999

(30) Foreign Application Priority Data

Apr. 14, 1999 (SE) ..... 9901325

(51) Int. Cl.[7] ..... H01J 47/00

(52) U.S. Cl. ..... 250/385.1; 250/385.2; 250/374; 250/375

(58) Field of Search ..... 250/385.1, 385.2, 250/374, 375

(56) References Cited

U.S. PATENT DOCUMENTS 5,347,131 A * 9/1994 Charpak ..... 250/385.2

5,959,302 A * 9/1999 Charpak ..... 250/385.1

FOREIGN PATENT DOCUMENTS

| | | |
|---|---|---|
| EP | 0810631 A1 | 12/1997 |
| WO | 99 23859 | 5/1999 |

* cited by examiner

*Primary Examiner*—Georgia Epps
*Assistant Examiner*—M. Hasan
(74) *Attorney, Agent, or Firm*—Birch, Stewart, Kolasch & Birch, LLP

(57) ABSTRACT

A detector (64) for detection of ionizing radiation, an apparatus for use in planar beam radiography, comprising such a detector, and a method for detecting ionizing radiation. The detector comprises: a chamber filled with an ionizable gas; first and second electrode arrangements (2, 1, 18, 19) provided in said chamber with a space between them, said space including a conversion volume (13); means for electron avalanche amplification (17) arranged in said chamber; and, at least one arrangement of read-out elements (15) for detection of electron avalanches. A radiation entrance is provided so that radiation enters the conversion volume between the first and second electrode arrangements. In order to achieve well-defined avalanches the means for electron avalanche amplification includes a plurality of avalanche regions.

21 Claims, 11 Drawing Sheets

RADIATION DETECTOR, AN APPARATUS FOR USE IN PLANAR BEAM RADIOGRAPHY AND A METHOD FOR DETECTING IONIZING RADIATION

FIELD OF THE INVENTION

The invention relates to a detector for detection of ionizing radiation, to an apparatus for use in planar beam radiography and to a method for detecting ionizing radiation.

BACKGROUND OF THE INVENTION AND RELATED ART

A detector and an apparatus of the kind mentioned above are described in the copending PCT-application PCT/SE98/01873, which is incorporated herein by reference. The detector described therein includes a gaseous parallel plate avalanche chamber. The detector provides good resolution, high X-ray detection efficiency, and possibility to count every photon absorbed in the detector. This provides a huge number of possibilities when processing the detection signals, such as energy detection, discriminating detection signals from photons in certain energy ranges or from photons incident at certain distance ranges from the anode or the cathode.

When using a detector of this kind in planar beam X-ray radiography, e.g. slit or scan radiography, an apparatus which provides that an object to be imaged only needs to be irradiated with a low dose of X-ray photons is achieved, while an image of high quality is obtained.

Another detector and apparatus of the kind mentioned above, in the section field of the invention, is disclosed in EP-A1-0 810 631.

For gaseous parallel plate avalanche chambers it has been regarded as necessary that the avalanche anode and cathode plates are parallel, and much effort has been made to achieve high parallelism between the plates. However, the critical point is that the distance where the electrons are subjected to avalanche amplification, i.e. the length of the electron avalanches, do not differ at different locations in the gaseous parallel plate avalanche chamber. The reason for this is that the amplification is strongly dependent on the distance from the starting point to the end point of the avalanche. However, avalanche anodes and cathodes have large dimensions, in the planes they extend, compared with the distance between them. Therefore, it has been very complicated and costly to obtain a sufficient uniformity of those distances or gaps.

SUMMARY OF THE INVENTION

The present invention is directed to a one-dimensional detector for detection of ionizing radiation, which employs avalanche amplification, and provides well defined avalanches, and which can be manufactured in a simple and cost effective way.

This and other objects are attained by a detector having a chamber filled with an ionizable gas and a radiation entrance, the detector comprising first and second electrode arrangements located within the chamber, spaced apart such that a portion of the space therebetween acts as a conversion and drift volume, wherein the radiation entrance permits radiation, including electrons, to enter the conversion and drift volume, an electron avalanche amplification unit including at least one avalanche cathode and the at least one avalanche anode, between which a voltage can be applied to create an electric field in the vicinity of each of a plurality of avalanche regions formed by an arrangement of the at least one avalanche cathode and at least one avalanche anode, and at least one arrangement of read-out elements for detecting electron avalanches in the plurality of avalanche regions.

The above detector can be given a length, in the direction of the incoming radiation, for achieving a desired stopping power, which makes it possible to detect a major portion of the incoming radiation.

In the detector electrons are released by interactions between photons and gas atoms and can be extracted in a direction essentially perpendicular to the incident radiation to obtain a very high position resolution.

The above detector also can provide good resolution, high X-ray detection efficiency, and count a major portion of the photons incident in the detector.

A detector which provides good energy resolution for X-rays is also obtained.

The above detector can also operate at high X-ray fluxes without performance degradation and has a long lifetime.

The above detector can also be used for effective detection of any kind of radiation, including electromagnetic radiation as well as incident particles, including elementary particles. The present invention is directed to an apparatus for use in planar beam radiography, comprising at least one one-dimensional detector for detection of ionizing radiation, which employs avalanche amplification, provides well defined avalanches, and can be manufactured in a simple and cost effective way.

This and other objects are attained by an apparatus for use in planar beam radiography, comprising an X-ray source, means for forming an essentially planar X-ray beam positioned between said X-ray source and an object to be imaged, wherein it further comprises a detector as described above.

The above apparatus can be used in planar beam radiography, e.g. slit or scan radiography, such that an object to be imaged only needs to be irradiated with a low dose of X-ray photons, to obtain a high quality image.

The above apparatus can also be used in planar beam radiography, in which a major fraction of the X-ray photons incident on the detector can be detected, for further counting or integration in order to obtain a value for each pixel of the image.

The above apparatus can also be used in planar beam radiography, in which image noise caused by radiation scattered in an object to be examined is strongly reduced.

The above apparatus can also be used in planar beam radiography, in which image noise caused by the spread of X-ray energy spectrum is reduced.

The above apparatus can also be used in planar beam radiography, including a simple and inexpensive detector that can operate with high X-ray detection efficiency and with good energy resolution for X-rays.

The above apparatus can also be used in planar beam radiography, including a detector which can operate at high X-ray fluxes without a performance degradation and has a long lifetime.

The present invention is also directed to a method for detection of ionizing radiation, which employs avalanche amplification, provides well defined avalanches, and can be implemented in a simple and cost effective way.

This and other objects are attained by a method for detecting ionizing radiation, wherein the radiation interacts with gas atoms in a gas filled conversion and drift volume, for creation of released electrons, wherein the electrons are subjected to a first electric field in the conversion and drift volume, said first electric field being substantially perpendicular to the direction of the radiation, in each of a plurality of regions a concentrated electric field for causing electron avalanches is formed, said first electric field forcing the electrons to enter one of said plurality of regions with a concentrated electric field, and said electron avalanches being detected by means of read-out elements.

The above method makes it possible to detect a major portion of the incoming radiation.

In the above method electrons released by interactions between photons and gas atoms are extracted in a direction perpendicular to the incident radiation, to thereby obtain a very high position resolution.

The above method can be used at high X-ray fluxes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF PREFERRED EMBODIMENTS

Figure 1:
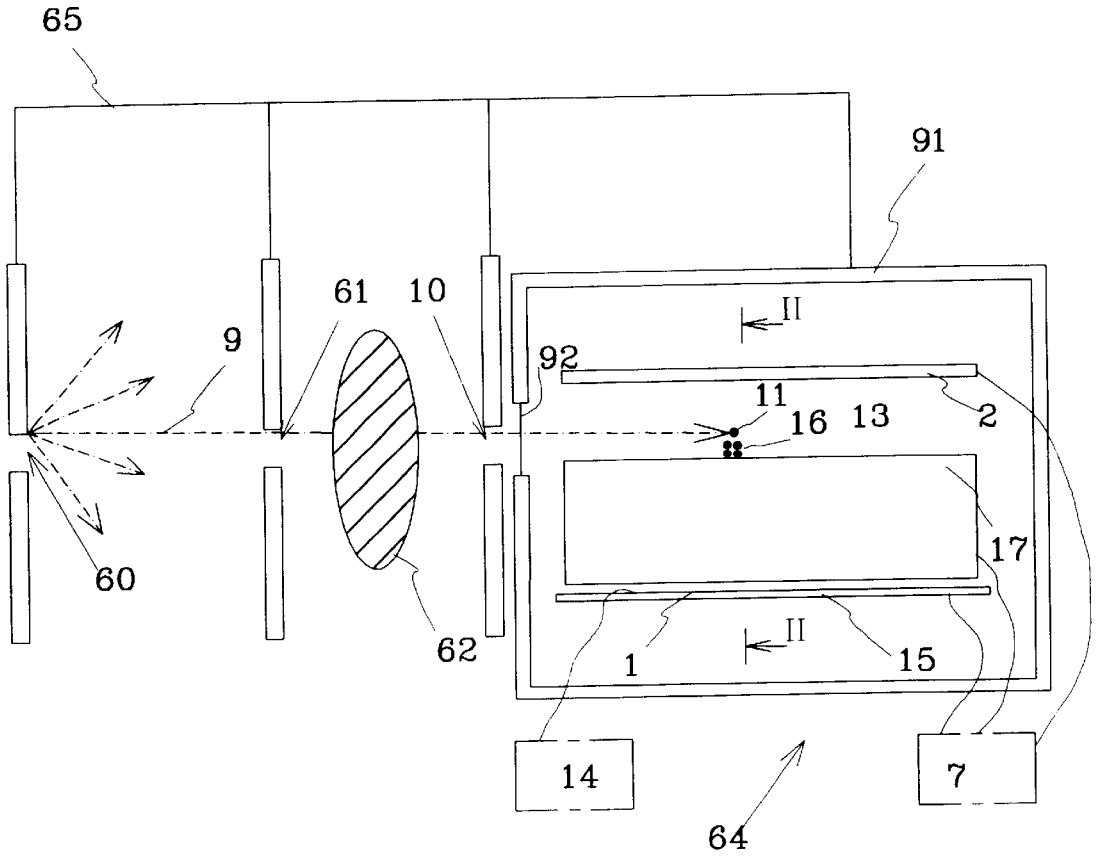
FIG. 1 illustrates schematically, in an overall view, an apparatus for planar beam radiography, according to a general embodiment of the invention.

FIG. 1 is a sectional view in a plane orthogonal to the plane of a planar X-ray beam 9 of an apparatus for planar beam radiography, according to the invention. The apparatus includes an X-ray source 60, which in combination with a first thin collimator window 61 produces a planar fan-shaped X-ray beam 9, for irradiation of an object 62 to be imaged. The first thin collimator window 61 can be replaced by other means for forming an essentially planar X-ray beam, such as an X-ray diffraction mirror or an X-ray lens etc. The beam transmitted through the object 62 enters a detector 64. Optionally a thin slit or second collimator window 10, which is aligned with the X-ray beam forms the entrance for the X-ray beam 9 to the detector 64. A major fraction of the incident X-ray photons are detected in the detector 64, which includes a conversion and drift volume 13, and an electron avalanche amplification unit 17, and is oriented so that the X-ray photons enter sideways between two electrode arrangements 1, 2, between which an electric field for drift of electrons and ions in the conversion and drift volume 13 is created. Collimator 61 collimates the planar X-ray beam.

The detector 64 and its operation will be further described below. The X-ray source 60, the first thin collimator window 61, the optional collimator window 10 and the detector 64 are connected and fixed in relation to each other by, for example, a frame or support 65. The so formed apparatus for radiography can be moved as a unit to scan an object, which is to be examined. In a single detector system, as shown in FIG. 1, scanning is achieved by a pivoting movement, rotating the unit around an axis through for example the X-ray source 60 or the detector 64. The location of the axis depends on the application or use of the apparatus, and possibly the axis can also run through the object 62, in some applications. Scanning can also be achieved by a translative movement where the detector and the collimator are moved, or the object to be imaged is moved. In a multiline configuration, where a number of detectors are stacked, as will be explained later, in connection with FIGS. 5 and 6, the scanning can be done in various ways. In many cases it may be advantageous if the apparatus for radiography is fixed and the object to be imaged is moved.

The detector 64 includes a first drift electrode arrangement being a cathode plate 2 and a second drift electrode arrangement being an anode plate 1. They are mutually parallel and the space in between includes a thin gas-filled gap or region 13, termed a conversion and drift volume, and the electron avalanche amplification unit 17. Alternatively the plates are non-parallel. A voltage is applied between the anode plate 1 and the cathode plate 2, and one or several voltages is (are) applied to the electron avalanche amplification unit 17. This results in a drift field causing drift of electrons and ions in the gap 13, and electron avalanche amplification fields in the electron avalanche amplification unit 17. In connection with the anode plate 1 is an arrangement 15 of read-out elements for detection of electron avalanches provided. Preferably the arrangement of read-out elements 15 also constitutes the anode electrode. Alternatively the arrangement of read-out elements 15 can be formed in connection with the cathode plate 2 or the electron avalanche amplification unit 17. The arrangement of read-out elements can also be formed on the anode or cathode plate separated from the anode or cathode electrode by a dielectric layer or substrate. In this case it is necessary that the anode or cathode electrode is semi-transparent to induced pulses, e.g. formed as strips or pads. In connection with FIGS. 3 and 4 below different possible arrangements 15 of read-out elements are shown.

As seen, the X-rays to be detected are incident sideways on the detector and enters the conversion and drift volume 13 between the cathode plate 2 and the anode plate 1. The X-rays enter the detector preferably in a direction parallel to the cathode plate 2 and the anode plate 1, and may enter the detector through a thin slit or collimator window 10. In this way the detector can easily be made with an interaction path long enough to allow a major fraction of the incident X-ray photons to interact and be detected. In the case a collimator is used, this should preferably be arranged so that the thin planar beam enters the detector close to the electron avalanche amplification unit 17 and preferably parallel therewith.

The gap or region 13 is filled with a gas, which can be a mixture of for example 90% krypton and 10% carbon dioxide or a mixture of for example 80% xenon and 20% carbon dioxide. The gas can be under pressure, preferably in a range 1–20 atm.

Therefore, the detector includes a gas tight housing 91 with a slit entrance window 92, through which the X-ray beam 9 enters the detector. The window is made of a material, which is transparent for the radiation, e.g. Mylar®, or a thin aluminum foil. This is a particularly advantageous additional effect of the invention, detecting sideways incident beams in a gaseous avalanche chamber 64, compared to previously used gaseous avalanche chambers, which were designed for radiation incident perpendicular to the anode and cathode plates, requiring a window covering a large area. The window can in this way be made thinner, thus reducing the number of X-ray photons absorbed in the window.

In operation, the incident X-rays 9 enter the detector through the optional thin slit or collimator window 10, if present, close to the electron avalanche amplification unit 17, and travel through the gas volume in a direction preferably parallel with the electron avalanche amplification unit 17. Each X-ray photon produces a primary ionization electron-ion pair within the gas as a result of interaction with a gas atom. This production is caused by photoeffect, Compton-effect or Auger-effect. Each primary electron 11 produced looses its kinetic energy through interactions with new gas atoms, causing further production of electron-ion pairs (secondary ionization electron-ion pairs). Typically between a few hundred and thousand secondary ionization electron-ion pairs are produced from a 20 keV X-ray photon in this process. The secondary ionization electrons 16 (together with the primary ionization electron 11) will drift towards the electron avalanche amplification unit 17 due to the electric field in the conversion and drift volume 13. When the electrons enter regions of focused field lines of the electron avalanche amplification unit 17 they will undergo avalanche amplification, which will be described further below.

The movements of the avalanche electrons and ions induce electrical signals in the arrangement 15 of read-out elements for detection of electron avalanches. Those signals are picked up in connection with the electron avalanche amplification unit 17, the cathode plate 2 or the anode plate 1, or a combination of two or more of said locations. The signals are further amplified and processed by readout circuitry 14 to obtain accurate measurements of the X-ray photon interaction points, and optionally the X-ray photon energies.

Figure 2A:
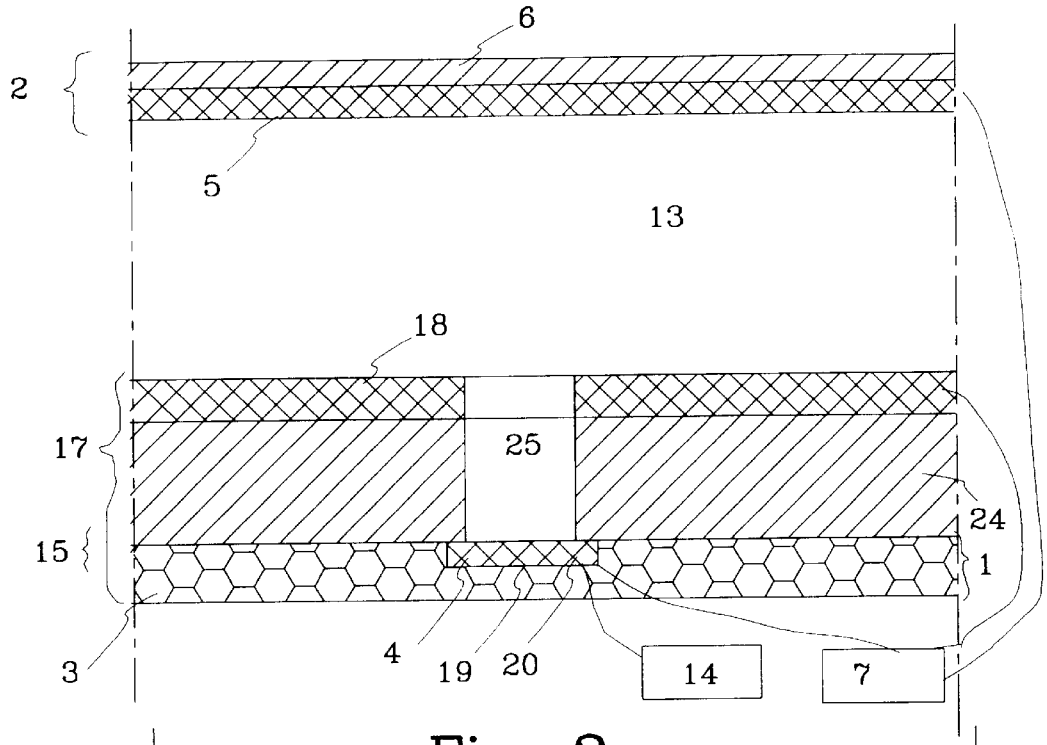
FIG. 2*a* is a schematic, partly enlarged, cross sectional view, taken at II—II in FIG. 1, of a detector according to a first specific embodiment of the invention.

FIG. 2*a* shows a schematic, partly enlarged, cross sectional view, taken at II—II in FIG. 1, of a detector according to a first specific embodiment of the invention. As seen, the cathode plate 2 comprises a dielectric substrate 6 and a conductive layer 5 being a cathode electrode. The anode 1 comprises a dielectric substrate 3 and a conductive layer 4 being an anode electrode. Between the gap 13 and the anode 1 an electron avalanche amplification unit 17 is arranged. This amplification unit 17 includes an avalanche amplification cathode 18 and an avalanche amplification anode 19, separated by a dielectric 24. This could be a gas or a solid substrate 24 carrying the cathode 18 and the anode 19, as shown in the figure. As seen, the anode electrodes 4 and 19 are formed by the same conductive element. Between the cathode 18 and the anode 19 a voltage is applied by means of a DC power supply 7 for creation of a very strong electric field in an avalanche amplification region 25. The avalanche region 25 is formed in a region between and around the edges of the avalanche cathode 18 which are facing each other, where a concentrated electric field will occur due to the applied voltages. The DC power supply 7 is also connected with the cathode electrode 5 and the anode electrode 4 (19). The voltages applied are selected so that a weaker electric field, drift field, is created over the gap 13. Electrons (primary and secondary electrons) released by interaction in the conversion and drift volume 13 will drift, due to the drift field, towards the amplification unit 17. They will enter the very strong avalanche amplification fields and be accelerated. The accelerated electrons 11, 16 will interact with other gas atoms in the region 25 causing further electron-ion pairs to be produced. Those produced electrons will also be accelerated in the field, and will interact with new gas atoms, causing further electron-ion pairs to be produced. This process continues during the travel of the electrons in the avalanche region towards the anode 19 and an electron avalanche is formed. After leaving the avalanche region the electrons will drift towards the anode 19. The electron may continue up to the anode 19 if the electric field is strong enough.

The avalanche region 25 is formed by an opening or channel in the cathode 18 and the dielectric substrate 24, if present. The opening or channel can be circular, seen from above, or continuous, longitudinal extending between two edges of the substrate 24, if present, and the cathode 18. In the case the openings or channels are circular when seen from above they are arranged in rows, each row of openings or channels including a plurality of circular openings or channels. A plurality of longitudinal openings or channels or rows of circular channels are formed beside each other, parallel with each other or with the incident X-rays. Alternatively, the circular openings or channels can be arranged in other patterns.

Figure 3:
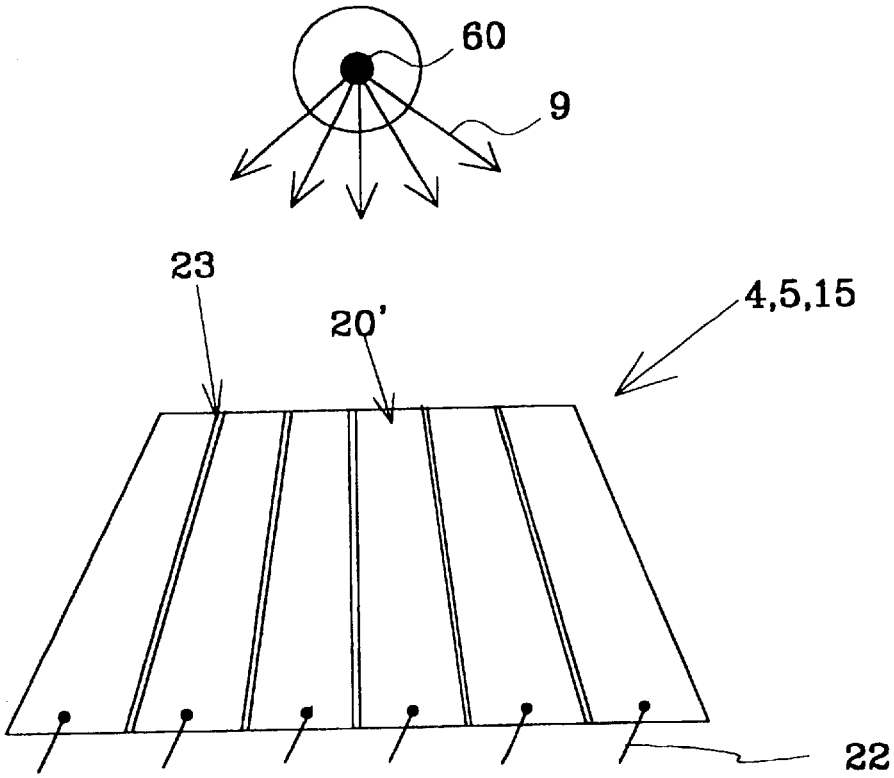
FIG. 3 is a schematic view of an embodiment of an X-ray source and an electrode formed by readout strips.
Figure 4:
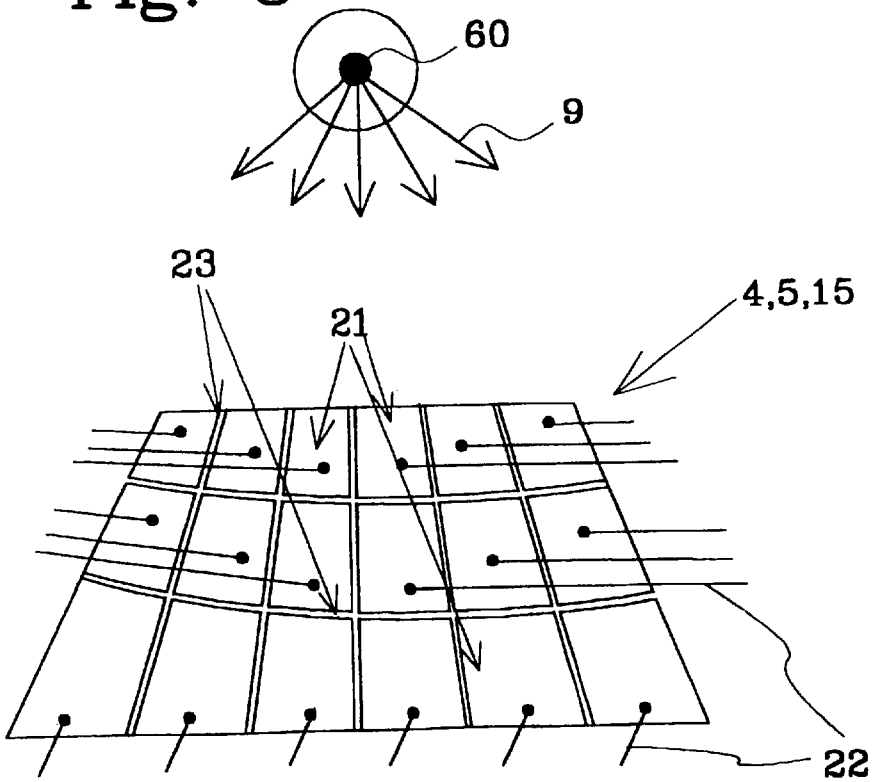
FIG. 4 is a schematic top view of a second embodiment of an X-ray source and an electrode formed by segmented readout strips.

The anode electrodes 4, 19 also form readout elements 20, as shown in FIGS. 3 and 4, in the form of strips provided in connection with the openings or channels forming the avalanche regions 25. Preferably one strip is arranged for each opening or channel or row of openings or channels. The strips could be divided into sections along its length, where one section could be provided for each circular opening or channel or for a plurality of openings or channels, in the form of pads. The strips and the sections, if present, are electrically insulated from each other. Each detector electrode element i.e. a strip or section is preferably separately connected to processing electronics 14. Alternatively the read-out elements can be located on the back side of the substrate (opposite the side of the anode electrodes 4, 19). In this case it is necessary that the anode electrodes 4, 19 are semi-transparent to induced pulses, e.g. in the form of strips or pads. In connection with FIGS. 3 and 4 below different possible arrangements 15 of read-out elements are shown.

Figure 2B:
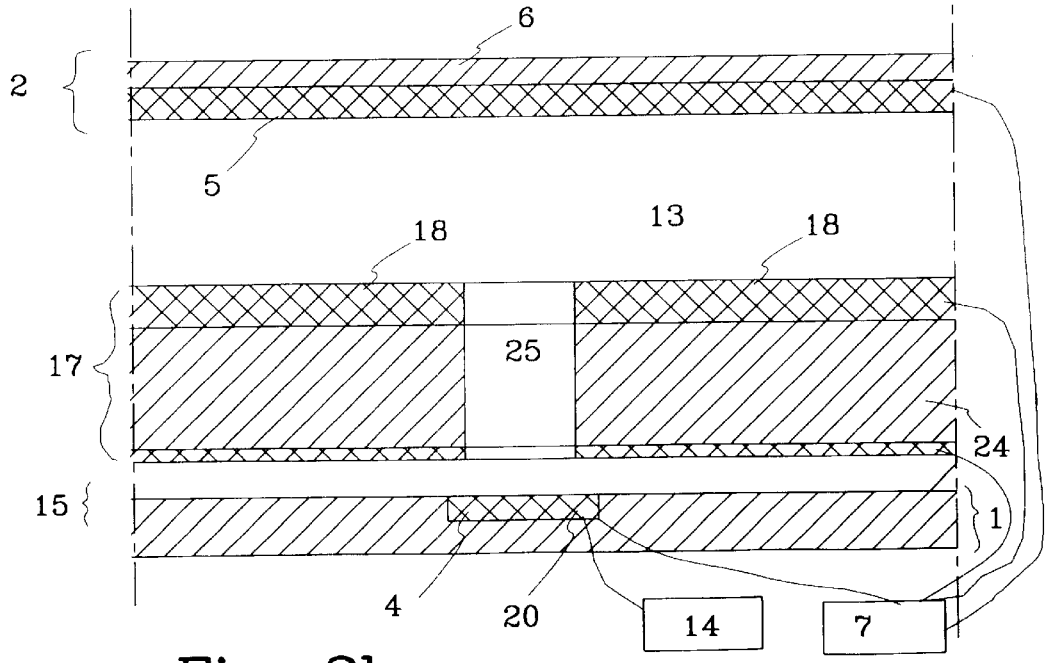
FIG. 2*b* is a schematic, partly enlarged, cross sectional view, taken at II—II in FIG. 1, of a detector according to a second specific embodiment of the FIG. 2*c* is a schematic, partly enlarged, cross sectional view, taken at II—II in FIG. 1, of a detector according to a third specific embodiment of the invention.
Figure 2C:
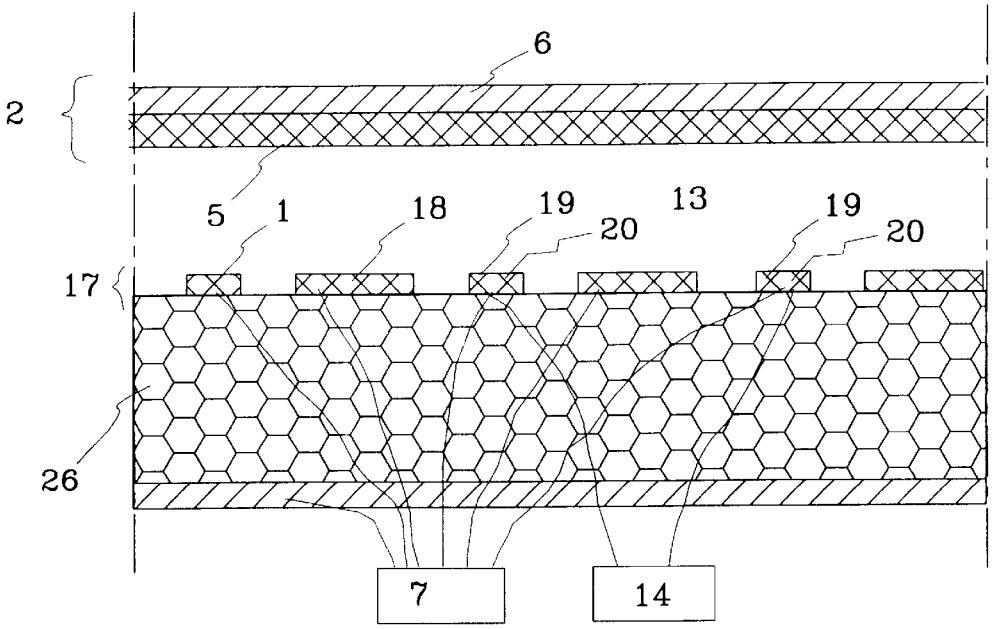
FIGS. 2*d*–2*l* are schematic, partly enlarged, cross sectional views, taken at II—II in FIG. 1, of a detector according to further embodiments of the invention.
Figure 2D:
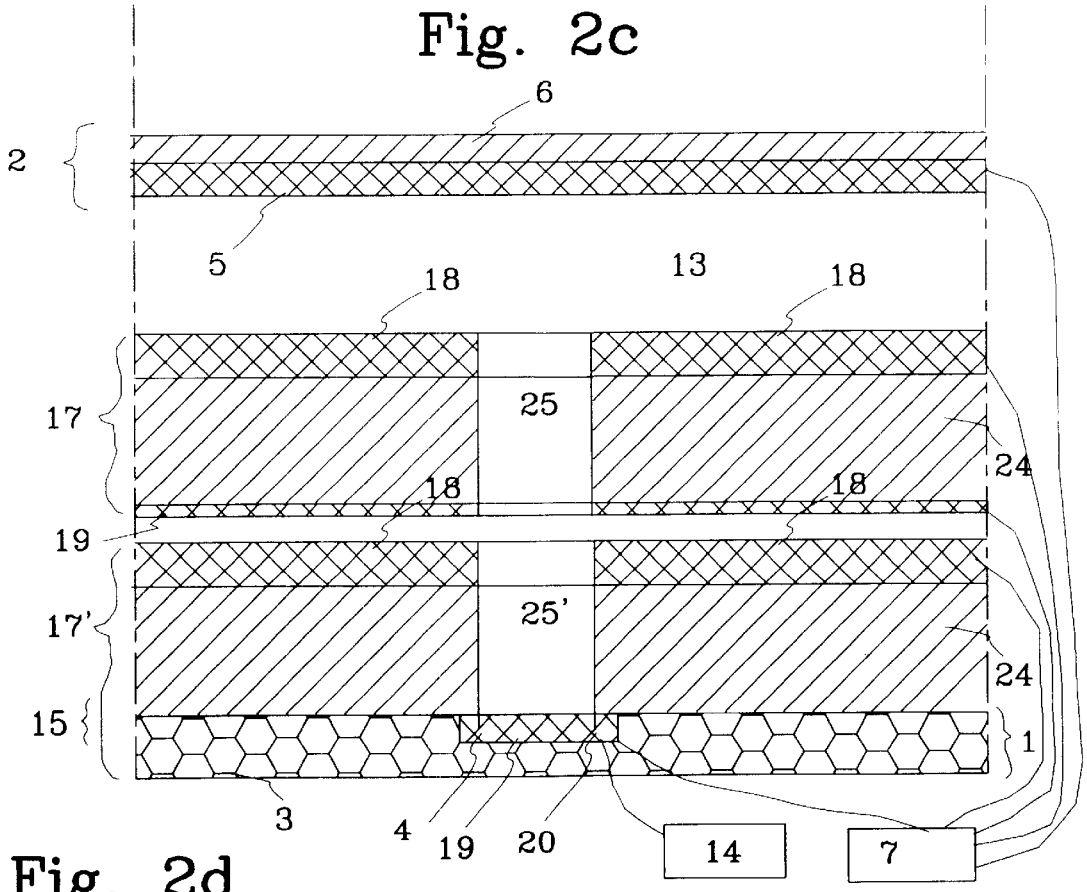
Figure 2E:
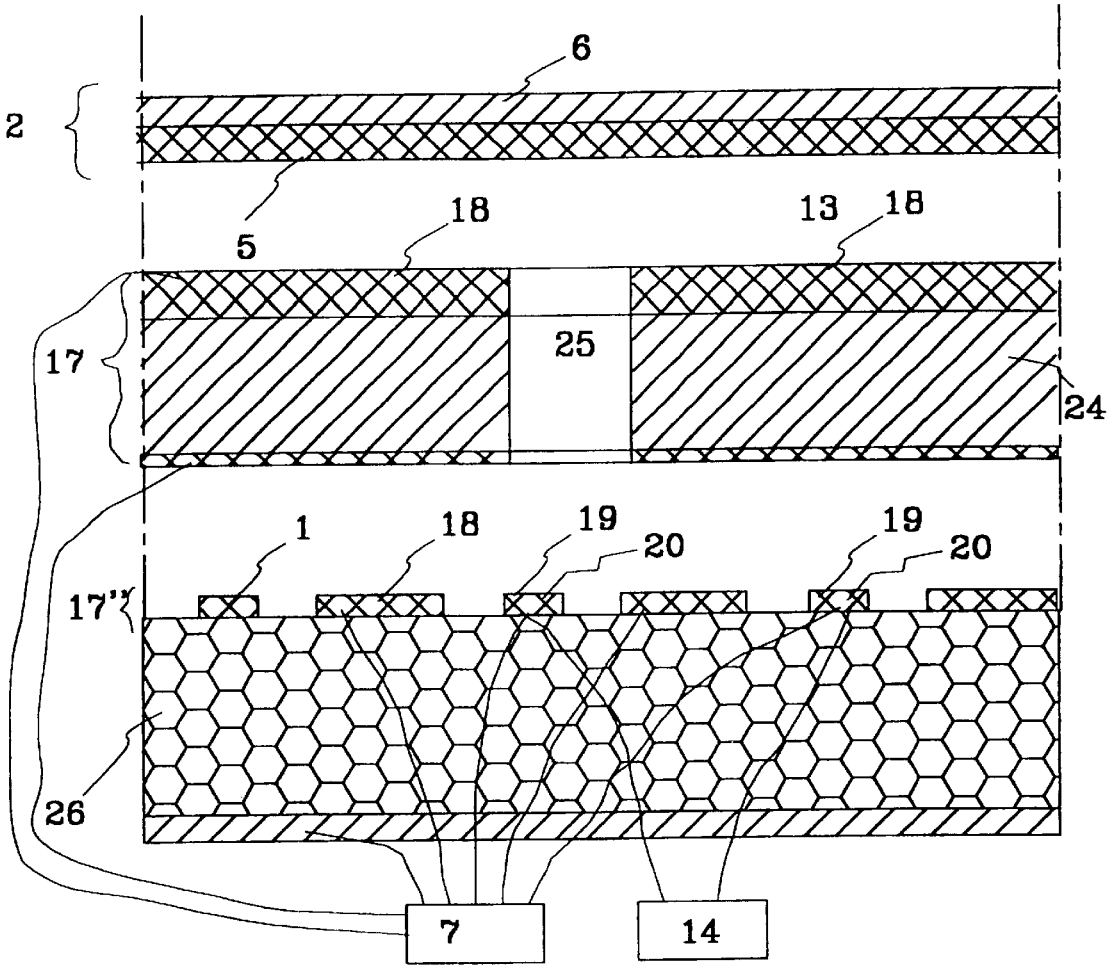
Figure 2F:
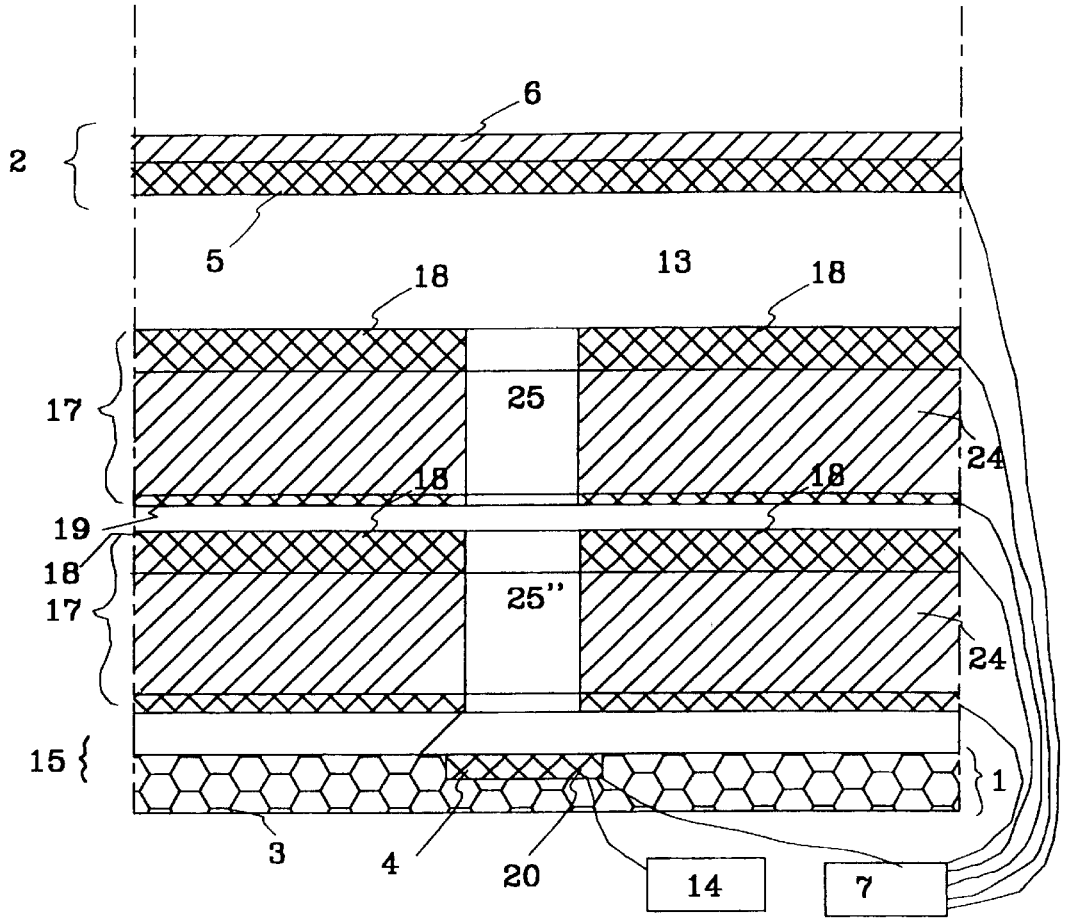
Figure 2G:
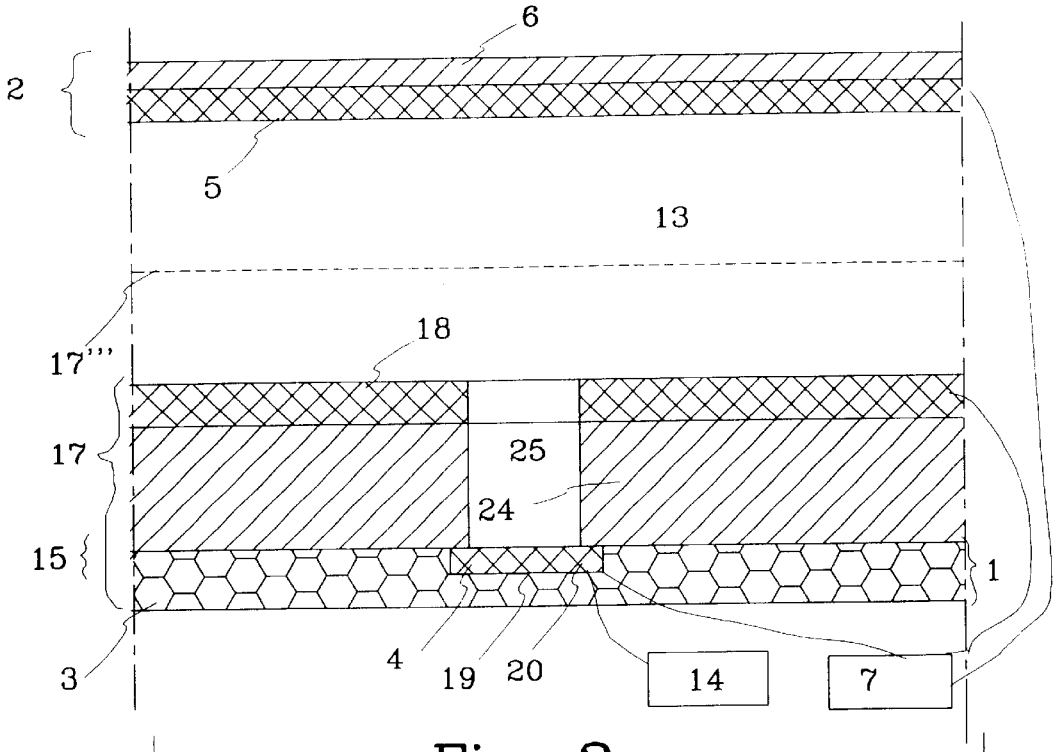
Figure 2H:
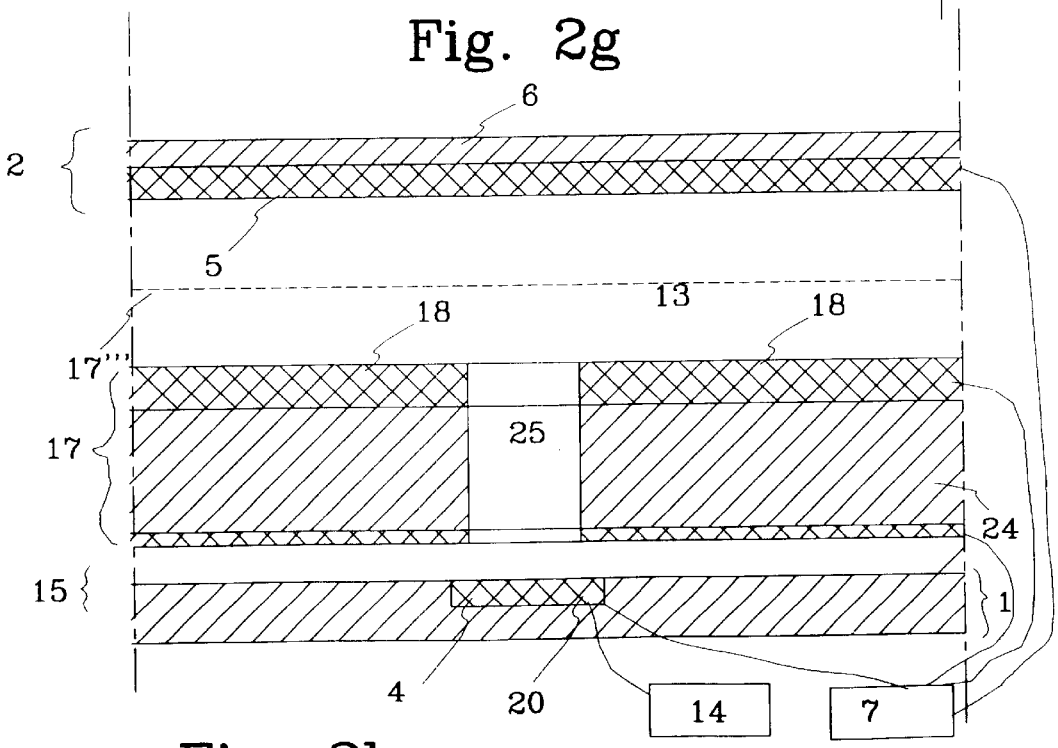
Figure 2I:
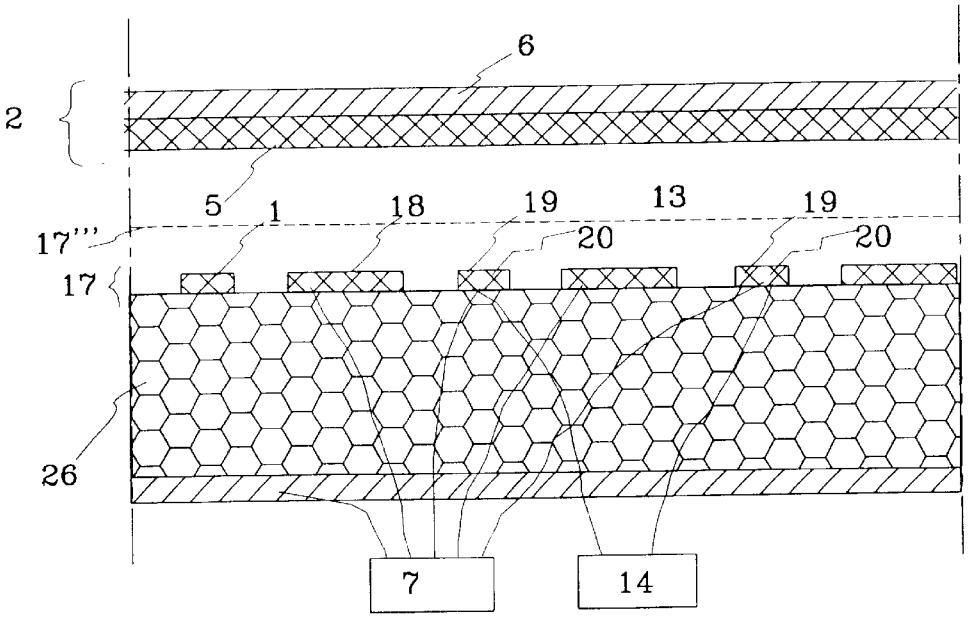
Figure 2J:
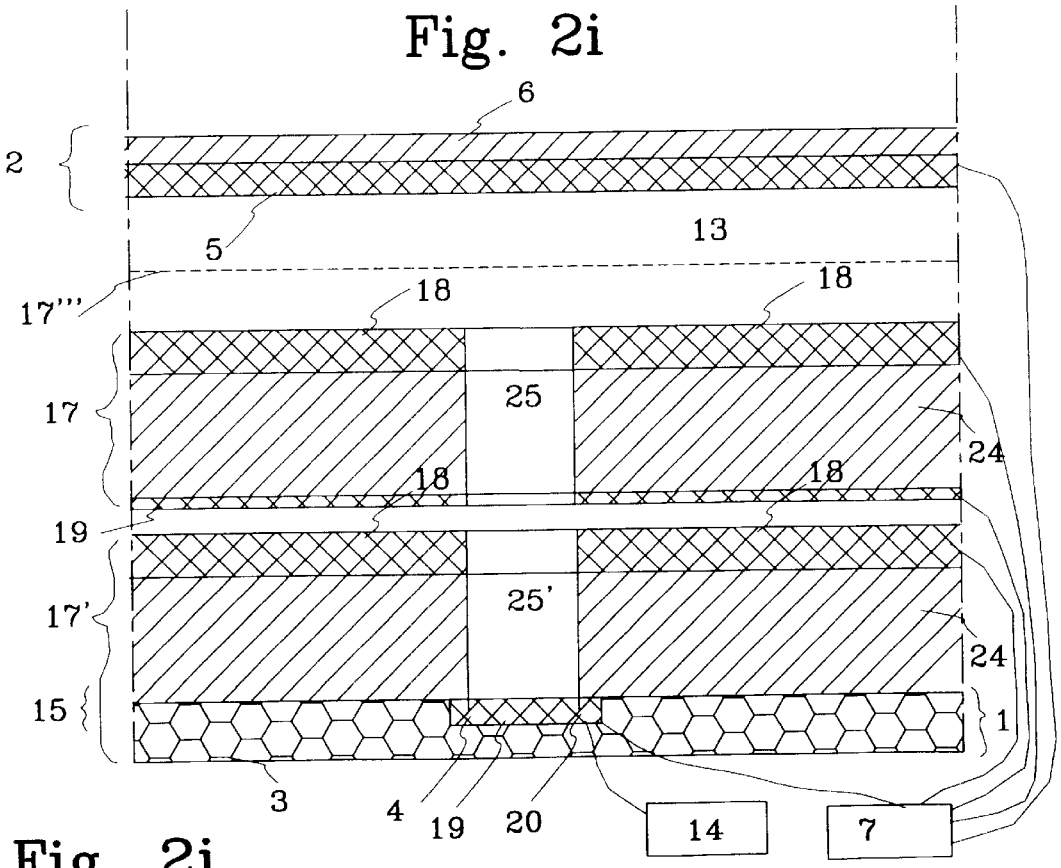
Figure 2K:
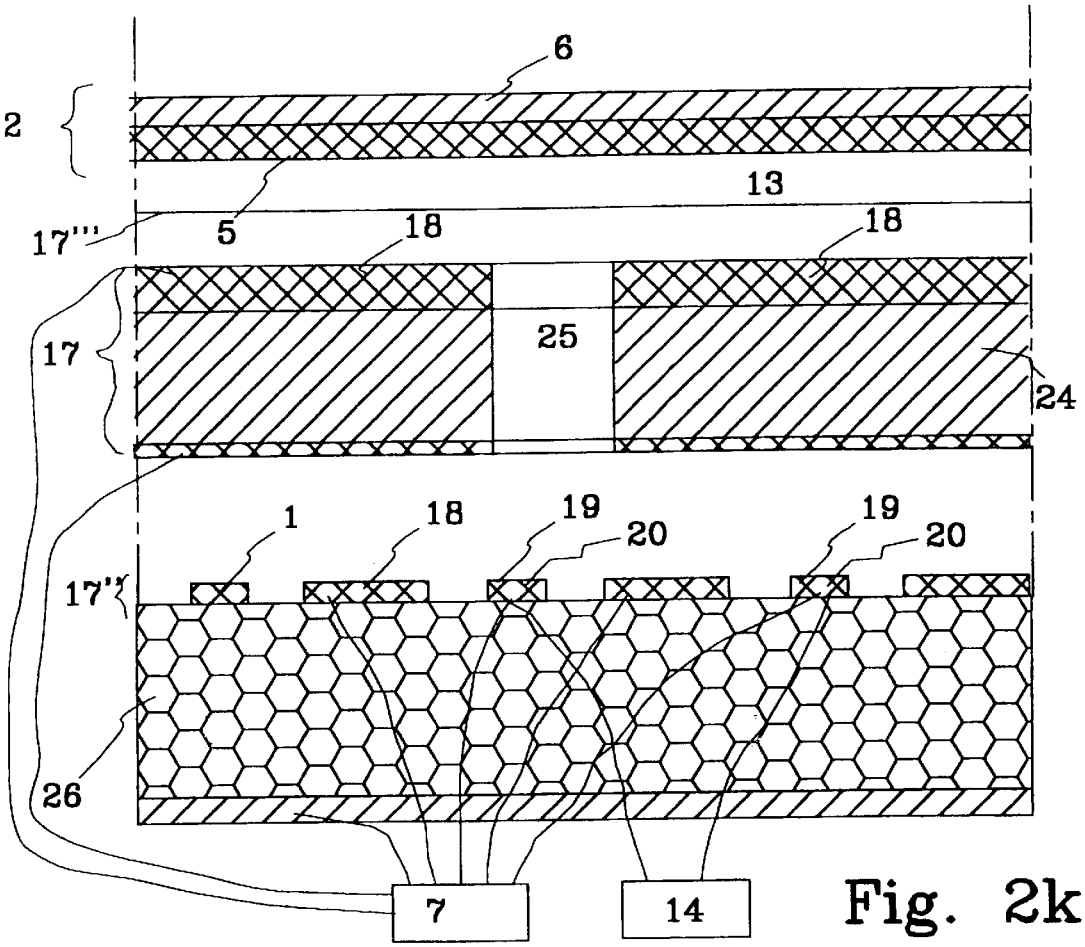
Figure 21:
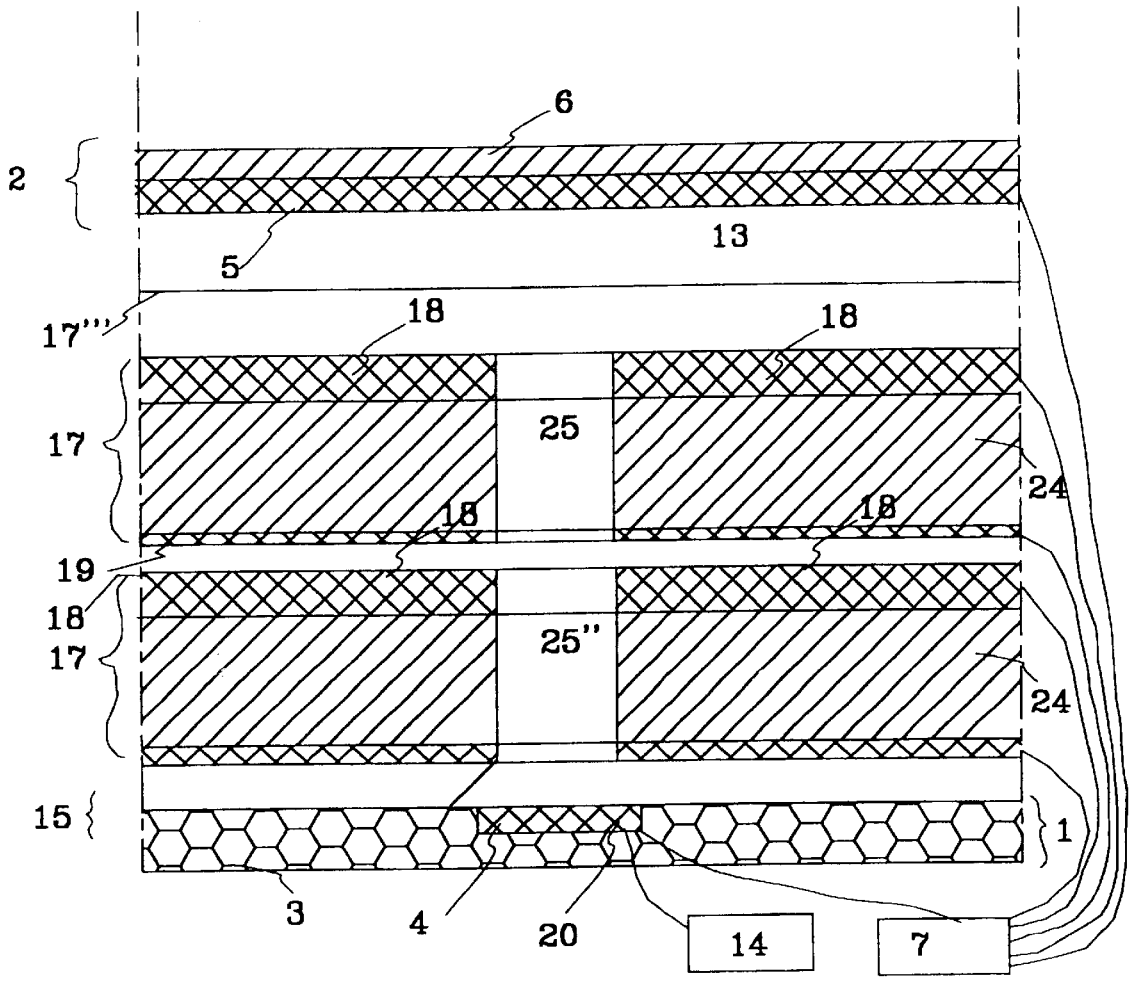

FIGS. 2*j*, 2*k*, 2*l* show schematic, partly enlarged, cross sectional views, taken at II—II in FIG. 1, of a detector according to a tenth, eleventh and twelfth specific embodiment of the invention, respectively. These embodiments differ from the embodiments according to FIGS. 2*d*, 2*e* and 2*f* respectively in that a thin grid is arranged between the cathode plate 2 and the avalanche amplification units 17, 17', 17". The grid acts as an amplification unit and causes further electron-ion pairs to be produced as mentioned above.

As an example the longitudinal channels can have a width in the range 0.01–1 mm, the circular channels can have a diameter of the circle in the range 0.01–1 mm, and the thickness of the dielectric 24 (separation between the avalanche cathode 18 and anode 19) is in the range 0.01–1 mm.

Alternatively the conductive layers 5, 4 can be replaced by a resistive carrier of e.g. silicon monoxide, conductive glass or diamond, with the dielectric substrates 3, 6 replaced by a conductive layer. In such a case a dielectric layer or carrier is preferably arranged between the conductive layer and the readout elements 20 when they are located in connection with a drift electrode arrangement.

FIG. 2*b* shows a schematic, partly enlarged, cross sectional view, taken at II—II in FIG. 1, of a detector according to a second specific embodiment of the invention. This embodiment differs from the embodiment according to FIG. 2*a* in that the anode electrodes 4 and 19 are formed by different conductive elements, being spaced by a dielectric, which could be solid or a gas, and that the openings or channels also are formed in the avalanche anode electrode 19. The avalanche amplification anode 19 is connected to the DC power supply 7. In the case the dielectric between the anode electrodes 4 and 19 is solid, it includes openings or channels through the dielectric, the openings or channels essentially corresponding the openings or channels forming the avalanche regions 25. An electric field is created between the anode electrodes 4 and 19. This field could be a drift field, i.e. a weaker field, or an avalanche amplification field, i.e. a very strong electric field. In connection with FIGS. 3 and 4 below different possible arrangements 15 of read-out elements are shown.

FIG. 2*c* shows a schematic, partly enlarged, cross sectional view, taken at II—II in FIG. 1, of a detector according to a third specific embodiment of the invention. The detector includes a cathode 2, as described above, an anode 1, and an avalanche amplification unit 17. A gap 13 termed a conversion and drift volume is provided between the cathode 2 and the avalanche amplification unit 17. The gap 13 is gas filled and the cathode 2 is formed as described above. The drift anode 1 is provided on a back surface of a dielectric substrate 26, e.g. a glass substrate. On the front surface of the substrate 26, avalanche amplification cathode 18 and anode 19 strips are alternately provided. The cathode 18 and anode 19 strips are conductive strips, and are connected to the DC power supply 7, for creation of a concentrated electric field, i.e. an avalanche amplification field in each region between a cathode strip 18 and an anode 19 strip. The anode 1 and cathode 2 are also connected to the DC power supply 7. The voltages applied are selected so that a weaker electric field, drift field, is created over the gap 13. Alternatively the dielectric substrate 26 can be replaced by a gas. FIG. 2*a* illustrates that the avalanche amplification cathode 18, the avalanche amplification anode 19, and the dielectric 24 are supported by anode plate 1. In an arrangement such as the one shown in FIG. 2*b*, it may be necessary to provide supports for the avalanche amplification cathode 18, the avalanche amplification anode 19, and the dielectric 24, in order to maintain the space between the avalanche amplification anode 19, and the cathode 1. Such supports may be any type of structure known to one of ordinary skill in the art, such as brackets, pedestals, or any other variation, which would maintain the space between the avalanche amplification anode 19 and the anode plate 1.

Preferably the avalanche anode strips 19 also forms the read out elements 20, and are then connected to the processing electronics 14. The avalanche cathode strips 18 could instead form the read out elements, or together with the anode strips 19. As an alternative the anode electrode 1 can be constituted of strips, which can be segmented and insulated from each other. Those strips could then form the read out elements alone or together with the anode and/or cathode strips. The strips acting as anode/cathode and read out element are connected to the DC power supply 7 and the processing electronics 14, with appropriate couplings for separation. In a further alternative the cathode strips 18 and/or the anode strips 19 are formed by an underlying conductive layer covered by a resistive top layer, made of e.g. silicon monoxide, conductive glass or diamond. This reduces the power of possible sparks, which could appear in the gas due to the strong electric field. In a further alternative of an arrangement of read out strips the read out strips 20 are arranged under and parallel with the avalanche anode strips 19. The read out strips 20 are then made a little wider than the avalanche anode strips 19. If they are located under the anode 1 it is necessary that the anode electrode is semi-transparent to induced pulses, e.g. in the form of strips or pads. In yet another alternative the anode 1 can be omitted since the necessary electric fields can be created by means of the cathode electrodes 5, 18 and the anode electrodes 19.

As an example, the glass substrate is about 0.1–5 mm thick. Further, the conductive cathode strip has a width of about 20–1000 $\mu$m and the conductive anode strip has a width being about 10–200 $\mu$m, with a pitch of about 50–2000 $\mu$m. Cathodes and anodes can be divided into segments along their extension.

In operation, X-ray photons enter the space 13 in the detector of FIG. 2c essentially parallel with the avalanche cathode 18 and anode 19 strips. In the conversion and drift volume 13 the incident X-ray photons are absorbed and electron-ion pairs are produced as described above. A cloud of primary and secondary electrons, being the result of interactions caused by one X-ray photon drift towards the avalanche amplification unit 17. The electrons will enter the very strong electric field in the gas filled region between an anode strip and a cathode strip, which is an avalanche amplification region. In the strong electric field the electrons initiate electron avalanches. As a result the number of electrons which is collected on the anode strips is of a few orders of magnitude higher than the number of primary and secondary electrons (so called gas multiplication). One advantage with this embodiment is that each electron avalanche only induces a signal mostly on one anode element or essentially on one detector electrode element. The position resolution in one coordinate is therefore determined by the pitch.

In the embodiments described above different locations for the detector electrode arrangements have been described. There are many variations, e.g. more than one detector electrode arrangement can be provided, adjacent to each other with different directions of the strips or segments, or at separate locations.

FIG. 2*d* shows a schematic, partly enlarged, cross sectional view, taken at II—II in FIG. 1, of a detector according to a fourth specific embodiment of the invention. This embodiment differs from the embodiments according to FIG. 2*a* and FIG. 2*b* in that two avalanche amplification units 17, 17' are stacked one on top of the other. Avalanche amplification unit 17 corresponds essentially to the avalanche amplification unit 17 in FIG. 2*b* and avalanche amplification unit 17' corresponds essentially to the avalanche amplification unit 17 in FIG. 2*a* where each of the avalanche amplification units is described above. By stacking the avalanche amplification units 17, 17' on top of one another, the electron-ion pair amplification will occur in two regions resulting in a possibly higher overall amplification, compared to a single unit. The method also allows each of the amplification units 17 and 17' to possibly be operated at a lower gain, compared to a single unit, for the same overall amplification resulting in a better safety against sparks in the units.

FIG. 2*e* shows a schematic, partly enlarged, cross sectional view, taken at II—II in FIG. 1, of a detector according to a fifth specific embodiment of the invention. This embodiment differs from the embodiments according to FIGS. 2*b* and FIG. 2*c* in that two avalanche amplification units 17, 17" are stacked one on top of the other. Avalanche amplification unit 17 corresponds essentially to the avalanche amplification unit 17 in FIG. 2*b* and avalanche amplification unit 17" corresponds essentially to the avalanche amplification unit 17 in FIG. 2*c* where each of the avalanche amplification units 17, 17" is described above. Such a stacking of said avalanche amplification units causes further electron-ion pairs to be produced as mentioned above.

FIG. 2*f* shows a schematic, partly enlarged, cross sectional view, taken at II—II in FIG. 1, of a detector according to a sixth specific embodiment of the invention. This embodiment differs from the embodiments according to FIG. 2*b* in that two avalanche amplification units 17 are stacked one on top of the other. Avalanche amplification unit 17 corresponds essentially to the avalanche amplification unit 17 in FIG. 2*b* where said avalanche amplification units 17 is described above. Such a stacking of said avalanche amplification units 17 causes further electron-ion pairs to be produced as mentioned above.

FIG. 2*g* shows a schematic, partly enlarged, cross sectional view, taken at II—II in FIG. 1, of a detector according to a seventh specific embodiment of the invention. This embodiment differs from the embodiments according to FIG. 2*a* in that a thin grid 17'" is arranged between the cathode plate 2 and the avalanche amplification unit 17. The grid acts as an amplification unit and causes further electron-ion pairs to be produced as mentioned above.

FIG. 2*h* shows a schematic, partly enlarged, cross sectional view, taken at II—II in FIG. 1, of a detector according to a eighth specific embodiment of the invention. This embodiment differs from the embodiments according to FIG. 2*b* in that a thin grid 17'" is arranged between the cathode plate 2 and the avalanche amplification unit 17. The grid acts as an amplification unit and causes further electron-ion pairs to be produced as mentioned above.

FIG. 2*i* shows a schematic, partly enlarged, cross sectional view, taken at II—II in FIG. 1, of a detector according to a ninth specific embodiment of the invention. This embodiment differs from the embodiments according to FIG. 2*c* in that a thin grid 17'" is arranged between the cathode plate 2 and the avalanche amplification unit 17. The grid acts as an amplification unit and causes further electron-ion pairs to be produced as mentioned above.

FIGS. 2*j*, 2*k*, 2*l* show a schematic, partly enlarged, cross sectional views, taken at II—II in FIG. 1, of a detector according to a tenth, eleventh and twelfth specific embodiment of the invention respectively. These embodiments differ from the embodiments according to FIGS. 2*d*, 2*e* and 2*f* respectively in that a thin grid is arranged between the cathode plate 2 and the avalanche amplification units 17, 17', 17". The grid acts as an amplification unit and causes further electron-ion pairs to be produced as mentioned above.

Referring to FIG. 3, a possible configuration of a detector electrode arrangement 4, 5, 15, is shown. The electrode arrangement 4, 5, 15 is formed by strips 20', and can also act as anode or cathode electrode as well as detector electrode. A number of strips 20' are placed side by side, and extend in directions parallel to the direction of an incident X-ray photon at each location. The strips are formed on a substrate, electrically insulated from each other, by leaving a space 23 between them. The strips may be formed by photolithographic methods or electroforming, etc. The space 23 and the width of the strips 20' are adjusted to the specific detector in order to obtain the desired (optimal) resolution. In for example the embodiment of FIG. 2*a* the strips 20' should be placed under the openings or channels or rows of openings or channels and have essentially the same width as the openings or channels, or somewhat wider. This is valid for both the case that the detector electrode arrangement is located separated from the anode electrode 4 and for the case the detector electrode arrangement also constitutes the anode electrode 4.

Each strip 20' is connected to the processing electronics 14 by means of a separate signal conductor 22, where the signals from each strip preferably are processed separately. Where an anode or cathode electrode constitutes the detector electrode, the signal conductors 22 also connects the respective strip to the high voltage DC power supply 7, with appropriate couplings for separation.

As seen from the figure, the strips 20' and the spacings 23 aim at the X-ray source 60, and the strips grow broader along the direction of incoming X-ray photons. This configuration provides compensation for parallax errors.

The electrode arrangement shown in FIG. 3 is preferably the anode, but alternatively or conjointly the cathode can have the described construction. In the case the detector electrode arrangement 15 is a separate arrangement, the anode electrode 4 can be formed as a unitary electrode without strips and spacings. The same is valid for the cathode electrode or the anode electrode, respectively, when only the other thereof comprises the detector electrode arrangement. However, if the detector electrode arrangement is located on a substrate on the opposite side to a cathode or anode electrode, the anode or cathode electrode should be semi-transparent to induced pulses, e.g. formed as strips or pads.

In FIG. 4, an alternative configuration of an electrode is shown. The strips have been divided into segments 21, electrically insulated from each other. Preferably a small spacing extending perpendicular to the incident X-rays is provided between each segment 21 of respective strip. Each segment is connected to the processing electronics 14 by means of a separate signal conductor 22, where the signals from each segment preferably are processed separately. As in FIG. 3, where the anode or cathode electrode constitute the detector electrode, the signal conductors 22 also connects the respective strip to the high voltage DC power supply 7.

This electrode can be used when the energy of each X-ray photon is to be measured, since an X-ray photon having higher energy statistically causes a primary ionization after a longer path through the gas than an X-ray photon of lower energy. By means of this electrode, both the position of X-ray photon interaction and the energy of each X-ray photon can be detected. By statistical methods one can restore the spectrum of the incident photons with very high energy resolution. See for example E. L. Kosarev et al., Nucl. Instr and methods 208 (1983)637 and G. F. Karabadjak et al., Nucl. Instr and methods 217 (1983)56.

Generally for all embodiments, each incident X-ray photon causes one induced pulse in one (or more) detector electrode element. The pulses are processed in the processing electronics, which eventually shapes the pulses, and integrates or counts the pulses from each strip (pad or sets of pads) representing one pixel. The pulses can also be processed so as to provide an energy measure for each pixel.

Where the detector electrode is on the cathode side the area of an induced signal is broader (in a direction perpendicular to the direction of incidence of the X-ray photons) than on the anode side. Therefore, weighting of the signals in the processing electronics is preferable.

Figure 5:
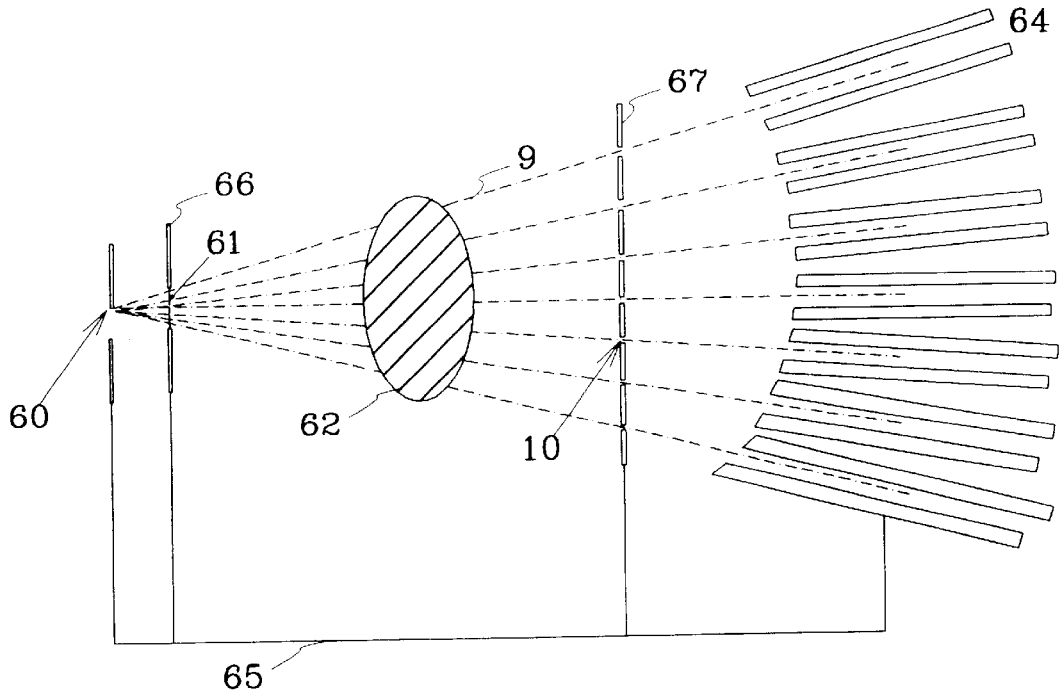
FIG. 5 is a schematic cross sectional view of an embodiment according to the invention, with stacked detectors.

FIG. 5 shows schematically an embodiment of the invention with a plurality of the inventive detectors 64 stacked, one on top of another. By this embodiment a multiline scan can be achieved, which reduces the overall scanning distance, as well as the scanning time. The apparatus of this embodiment includes an X-ray source 60, which together with a number of collimator windows 61 produce a number of planar fan-shaped X-ray beams 9, for irradiation of the object 62 to be imaged. The beams transmitted through the object 62 optionally enter the individual stacked detectors 64 through a number of second collimator windows 10, which are aligned with the X-ray beams. The first collimator windows 61 are arranged in a first rigid structure 66, and the optional second collimator windows 10 are arranged in a second rigid structure 67 attached to the detectors 64, or arranged separately on the detectors.

The X-ray source 60, the rigid structure 66, and the possible structure 67 including collimator windows 61, 10, respectively, and the stacked detectors 64, which are fixed to each other, are connected and fixed in relation to each other by for example a frame or support 65. The so formed apparatus for radiography can be moved as a unit to scan an object, which is to be examined. In this multiline configuration, the scanning can be done in a transverse movement, perpendicular to the X-ray beam, as mentioned above. It can also be advantageous if the apparatus for radiography is fixed and the object to be imaged is moved.

A further advantage of using a stacked configuration, compared to large single volume gas detectors, is reduction of background noise caused by X-ray photons scattered in the object 62. These scattered X-ray photons travelling in directions not parallel to the incident X-ray beam could cause "false" signals or avalanches in one of the other detectors 64 in the stack, if passing through anode and cathode plates and entering such a chamber. This reduction is achieved by significant absorption of (scattered) X-ray photons in the material of the anode and the cathode plates, or the collimator 67.

Figure 6:
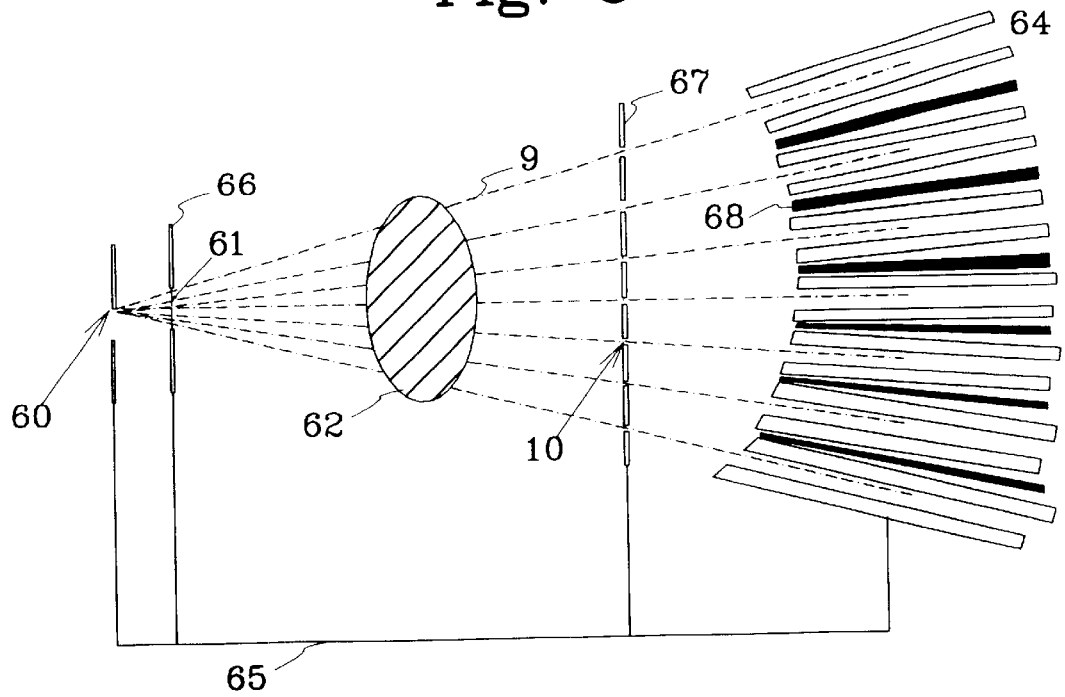
FIG. 6 is a schematic cross sectional view of a further embodiment according to the invention, with stacked detectors.

This background noise can be further reduced by providing thin absorber plates 68 between the stacked detectors 64, as shown in FIG. 6. The stacked detector is similar to that of FIG. 5, with the difference that thin sheets of absorbing material is placed between each adjacent detectors 64. These absorber plates or sheets can be made of a high atomic number material, for example tungsten.

As an alternative for all embodiments, the electric field in the conversion and drift gap (volume) can be kept high enough to cause electron avalanches, hence to be used in a pre-amplification mode.

In all embodiments the gas volumes are very thin, which results in a fast removal of ions, which leads to low or no accumulation of space charges. This makes operation at high rate possible.

In all embodiments the small distances leads to low operating voltages, which results in low energy in possible sparks, which is favorable for the electronics.

The focusing of the field lines in the embodiments is also favorable for suppressing streamer formations. A streamer is a form of channel of plasma in which a spark can form. This leads to a reduced risk for sparks.

Although the invention has been described in conjunction with a number of preferred embodiments, it is to be understood that various modifications may still be made without departing from the spirit and scope of the invention, as defined by the appended claims. For example the voltages can be applied in other ways as long as the described electrical fields are created.

What is claimed is:

1. A detector for planar beam radiography having a chamber filled with an ionizable gas in which the production of electron-ion pairs take place and a radiation entrance, the detector comprising;

first and second electrode arrangements located within the chamber, spaced apart such that a first portion of the space therebetween acts as a conversion and drift volume, the height of which is considerably less than 1 mm, and a second portion acts as two or more electron avalanche amplification units, wherein the radiation entrance permits radiation, including electrons, to enter the conversion and drift volume parallel to the first and second electrode arrangements;

said two or more electron avalanche amplification units include each at least one avalanche cathode and at least one avalanche anode, between which a voltage can be applied to create an electric field in the vicinity of each of a plurality of avalanche regions formed by an arrangement of said at least one avalanche cathode and said at least one avalanche anode and each of the electron avalanche amplification units includes field concentrating means; and at least one arrangement of read-out elements for detecting electron avalanches in the plurality of avalanche regions.

2. The detector according to claim 1, wherein said at least one avalanche cathode and said at least one avalanche anode are formed on the same side of a dielectric substrate with a spacing between said at least one avalanche cathode and said at least one avalanche anode, said spacing forming a limiting surface of a region for local avalanche amplification.

3. The detector according to claim 1, wherein said at least one avalanche cathode and said at least one avalanche anode include electrically conductive strips.

4. The detector according to claim 2, wherein a plurality of avalanche cathodes and anodes are alternatingly provided on the same side of said substrate.

5. The detector according to claim 4, wherein said avalanche cathodes and said avalanche anodes include electrically conductive strips having longitudinal edges being essentially parallel with the incident radiation.

6. The detector according to claim 1, wherein said at least one avalanche cathode being formed on a first side of a dielectric substrate and said at least one avalanche anode being formed on a second side of said dielectric substrate, at least one channel or opening being arranged in said least one avalanche cathode and said dielectric substrate, and said at least one avalanche anode forming a wall of said at lest one channel.

7. The detector according to claim 1, wherein said at least one avalanche cathode being formed on a first side of a dielectric substrate and said at least one avalanche anode being formed on a second side of said dielectric substrate, at least one channel or opening being arranged in said at least one avalanche cathode, said dielectric substrate, and said at least one avalanche anode.

8. The detector according to claim 6, wherein, said at least one channel or spring has an essentially circular cross section.

9. The detector according to claim 6, wherein, said at lest one channel has an essentially quadratic cross section and extends between two opposing edges of the dielectric substrate.

10. The detector according to claim 1, wherein, the read-out elements include elongated strips the width of which is equal to or a little wider than the avalanche anode strips and having longitudinal edges parallel with the incident radiation.

11. The detector according to claim 1, wherein, the read-out elements include elongated strips the width of which is equal to or a little wider than the avalanche anode strips and having longitudinal edges perpendicular to the incident radiation.

12. The detector according to claim 1, wherein, the first electrode arrangement is a drift cathode, the second electrode arrangement is a drift anode, the drift anode is arranged between the read-out elements and the avalanche anode.

13. The detector according to claim 1, wherein, the first electrode arrangement is a drift cathode, the second electrode arrangement is a drift anode, the drift cathode is arranged between the read-out elements and the avalanche cathode.

14. The detector according to claim 1, wherein a plurality of read-out elements in the form of strips the width of which is equal to or a little wider than the avalanche anode strips and are arranged under rows of avalanche regions.

15. The detector according to claim 1, wherein a read-out element in the form of a pad is arranged under each avalanche region or sets of avalanche regions.

16. The detector according to claim 1, wherein a thin slit or collimator window is arranged in connection with the radiation entrance so that radiation will be incident sideways between the first electrode arrangement and the avalanche cathode.

17. The detector according to claim 1, wherein a thin slit or collimator window is arranged in connection with the radiation entrance so that radiation will be incident close to and parallel to the avalanche cathode.

18. An apparatus for use in planar beam radiography, comprising:

an X-ray source, means for forming an essentially planar X-ray beam positioned between said X-ray source and an object to be imaged, wherein it further comprises a detector according to any of claim 1.

19. A method for detecting ionizing radiation, wherein the radiation interacts with gas atoms in a gas filled conversion and drift volume, for creation of released electrons, said method comprising the step of:

subjecting the electrons to a first electric field in the conversion and drift volume, said first electric field being substantially perpendicular to the direction of the radiation and forcing the electrons to enter one of a plurality of regions with a concentrated electric field for causing the formation of electron avalanches, and detecting said electron avalanches by means of read-out elements.

20. The method for detecting ionizing radiation according to claim 19, wherein signals caused by electron avalanches in each region with a concentrated electric field are detected separately.

21. The method for detecting ionizing radiation according to claim 19, wherein signals caused by electron avalanches in sets of regions with a concentrated electric field are detected separately.

* * * * *

UNITED STATES PATENT AND TRADEMARK OFFICE

CERTIFICATE OF CORRECTION

PATENT NO. : 6,414,317 B1
DATED : July 2, 2002
INVENTOR(S) : Tom Francke et al.

It is certified that error appears in the above-identified patent and that said Letters Patent is hereby corrected as shown below:

Title page,
Item [73], Assignee, please correct the name of the assignee from "XCOUNTER AG" to -- Xcounter AB --.

Signed and Sealed this

Twenty-second Day of April, 2003

JAMES E. ROGAN
*Director of the United States Patent and Trademark Office*